United States Patent [19]

Abendroth et al.

[11] Patent Number: 4,813,356

[45] Date of Patent: Mar. 21, 1989

[54] CLAMPING DEVICE FOR OPTIONALLY SECURING A BLANKET OR A PRINTING PLATE

[75] Inventors: Paul Abendroth, Offenbach am Main; Herbert Rebel, Rodgau; Manfred Herold, Kahl/Main, all of Fed. Rep. of Germany

[73] Assignee: M.A.N. Roland Druckmaschinen, Offenbach am Main, Fed. Rep. of Germany

[21] Appl. No.: 903,689

[22] Filed: Sep. 4, 1986

[30] Foreign Application Priority Data

Sep. 7, 1985 [DE] Fed. Rep. of Germany ..... 3532003

[51] Int. Cl.[4] ..... B41F 21/00

[52] U.S. Cl. ..... 101/415.1; 101/378; 101/383; 101/409; 101/DIG. 49

[58] Field of Search ..... 101/378, 382 R, 383, 101/415.1, DIG. 12, DIG. 28, 218, 409

[56] References Cited

U.S. PATENT DOCUMENTS

| | | | |
|---|---|---|---|
| 3,203,346 | 8/1965 | Norton et al. | 101/218 X |
| 3,557,695 | 1/1971 | Preuss | 101/415.1 |
| 3,788,216 | 1/1974 | Lambert | 101/415.1 X |
| 3,878,784 | 4/1975 | Dyrberg et al. | 101/415.1 |
| 4,010,685 | 3/1977 | Trageser | 101/415.1 |
| 4,263,849 | 4/1981 | Spae et al. | 101/415.1 |
| 4,408,529 | 10/1983 | Johne et al. | 101/415.1 |
| 4,596,188 | 6/1986 | Bonomi | 101/383 X |

FOREIGN PATENT DOCUMENTS

| | | |
|---|---|---|
| 1119877 | 12/1961 | Fed. Rep. of Germany . |
| 2035278 | 1/1972 | Fed. Rep. of Germany . |
| 2707643 | 8/1978 | Fed. Rep. of Germany . |

*Primary Examiner*—Paul T. Sewell
*Assistant Examiner*—James R. McDaniel

[57] ABSTRACT

A clamping device of a plate cylinder for recessed in-line varnishing in a rotary press which comprises two axis-parallel clamp bars having a top part and a bottom part, which are circumferentially adjustable in a parallel or an inclined relationship to one another in guides by means of clamp screws bearing against the plate cylinder, and which are axially adjustable by means of axial setscrews, and having a groove extending over the entire length of the clamp bars in the bottom part which provides for the insertion and fixing of reinforced bent ends of the blanket, and the top part is pivotally and slidably connected to the bottom part by locking devices and recesses for the clamping screws, and additional centering means are provided for at least two of the clamping screws.

4 Claims, 3 Drawing Sheets

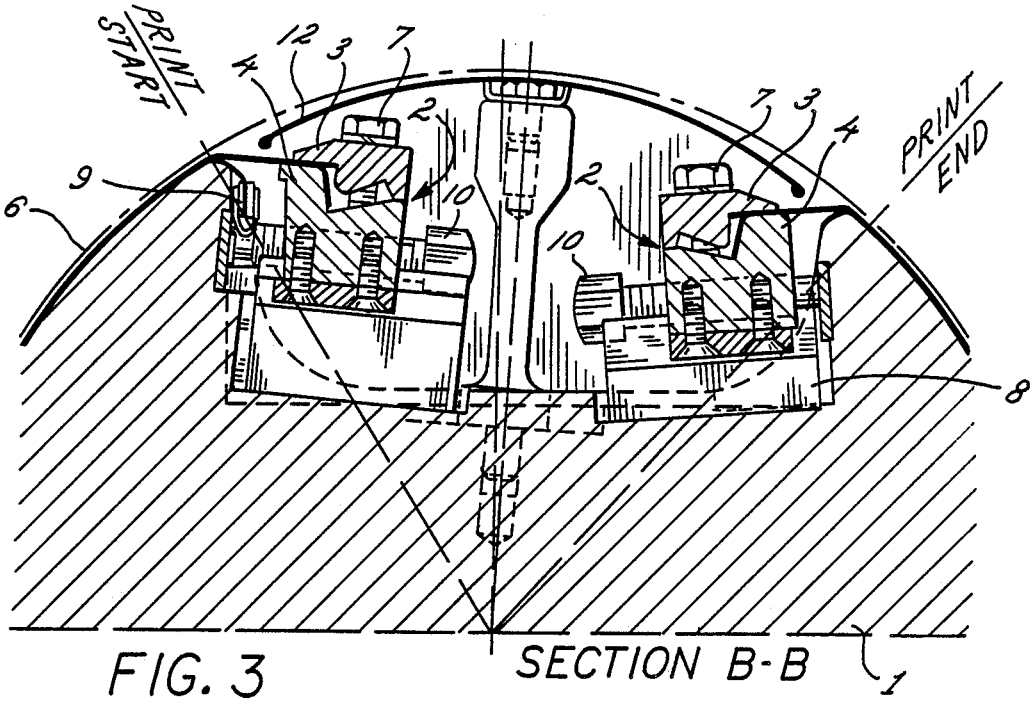
FIG. 3 SECTION B-B
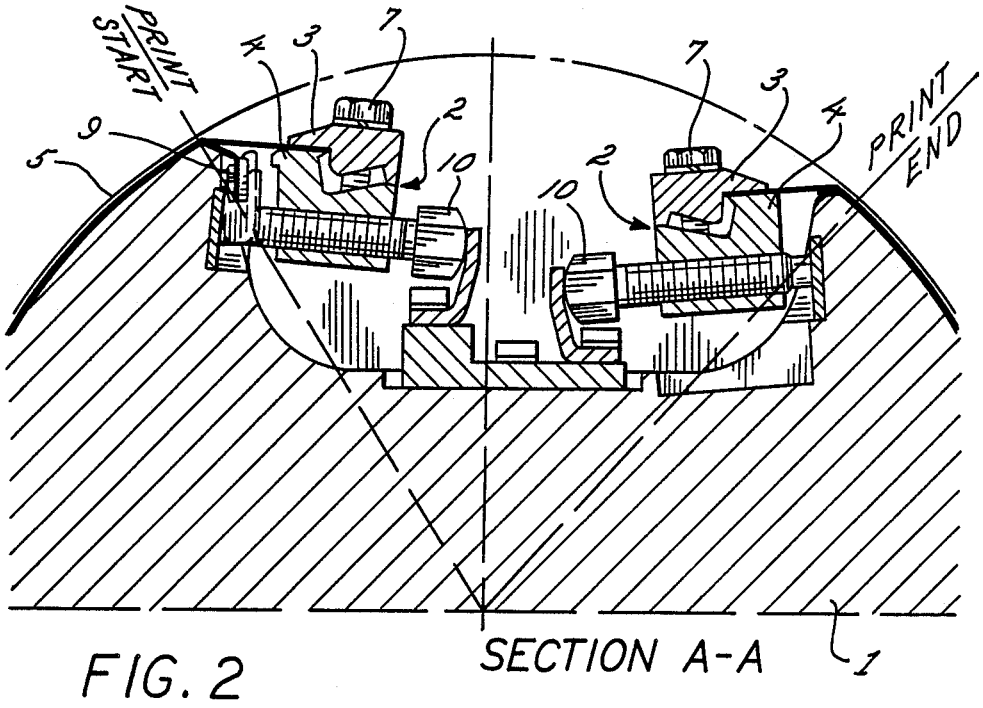
FIG. 2 SECTION A-A

SECTION D-D

SECTION E-E

SECTION C-C

SECTION C-C

CLAMPING DEVICE FOR OPTIONALLY SECURING A BLANKET OR A PRINTING PLATE

FIELD OF THE INVENTION

The present invention relates generally to a clamping device for fixing a blanket or a printing plate or the like on the plate cylinder of a printing press and more particularly concerns a dual-purpose clamping device which permits the clamping of a printing plate or a blanket for recessed in-line varnishing in a rotary press.

BACKGROUND OF THE INVENTION

In varnishing work, the varnish can be applied in the form of a full surface or recessed. In the former case blankets are normally used. In the case of varnish applications with simple recesses, a blanket is usually used while a printing plate, e.g. a Nylonprint-Letterset plate, is used for complicated recesses. When ordering a press, the client must decide between a clamping device which is designed either for the satisfactory fixing of a printing plate in the form of an adjustable plate clamping bar, or for the fixing of a blanket in the form of a blanket clamping device.

Unlike a printing plate clamping device, a clamping device to fix a blanket does not permit circumferential and lateral positioning in relation to the print. Unfortunately, a conventional adjustable plate clamping device provided with the said positioning abilities does not allow satisfactory fixing of a blanket. Therefore, the utilization of a printing plate or a blanket in the same blanket clamping device or plate clamping bar presents considerable difficulties.

German Patent No. 1,119,877, discloses a device to clamp a printing plate or a blanket to a press cylinder by means of clamping spindles disposed in the cylinder channel so that different types of printing work can be carried out, e.g. dry offset, wet offset or letterpress printing. However, a disadvantage of this device is that the clamping lugs for a blanket have to be replaced with clamping lugs for a printing plate. Nor is blanket positioning possible because the clamping spindles are not adequately adjustable.

OBJECTS AND SUMMARY OF THE INVENTION

The primary object of the invention is to provide a device wherein circumferentially and axially adjustable clamping bars in a clamping device will permit satisfactory fixing of a blanket or a printing plate with respect to the plate cylinder.

This problem is solved according to the present invention by a clamping device for recessed in-line varnishing in a rotary press consisting of two axis-parallel clamp bars comprising a top part and a bottom part, which are circumferentially adjustable in a parallel or an inclined relationship to one another in guides by means of clamp screws bearing against the cylinder, and which are axially adjustable by means of lateral setscrews.

The clamp bars have a groove extending over the entire length of the bottom part of the cylinder which provides for the insertion and fixing of reinforced bent ends of the blanket. The top part of the clamp bar is pivotally and slidably connected to the bottom part by locking devices and recesses for the clamping screws.

At least two of the clamping screws have additional centering means.

The advantage of the invention is that accurate positioning of a blanket in relation to the print can be carried out by means of the clamping screws circumferentially and laterally in the case of recessed in-line varnishing in rotary presses. Since a printing plate can also be satisfactorily fixed in the dual-purpose clamping bar, greater flexibility is obtainable with reduced expenditure for converting the press.

These and other features and advantages of the invention will be more readily apparent upon reading the following description of a preferred exemplified embodiment of the invention and upon reference to the accompanying drawings wherein:

BRIEF DESCRIPTION OF THE DRAWINGS

FIG. 2 is an enlarged, partial cross-section along the line A—A in FIG. 1 showing the clamping device for a printing plate;

FIG. 3 is an enlarged, partial cross-section along the line B—B in FIG. 1 showing the clamping device for a blanket;

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
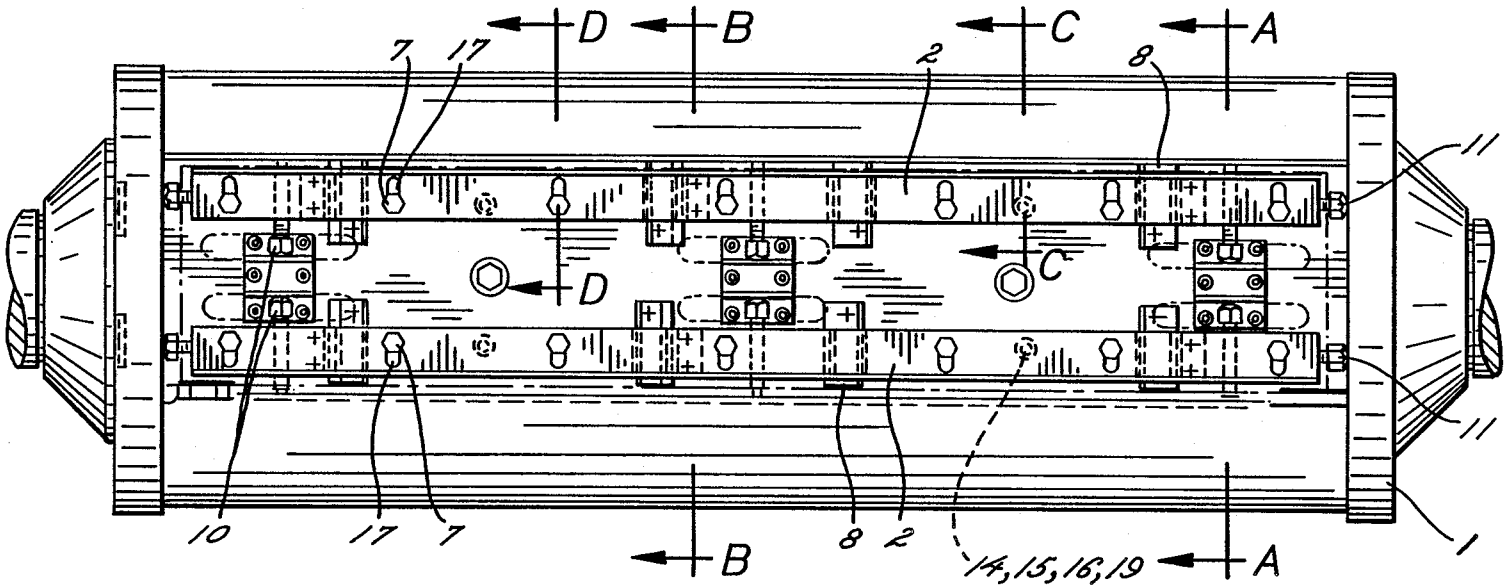
FIG. 1 is a plan view of the plate cylinder of the invention for recessed in-line varnishing which shows the plate cylinder channel and the clamping device.
Figure 6:
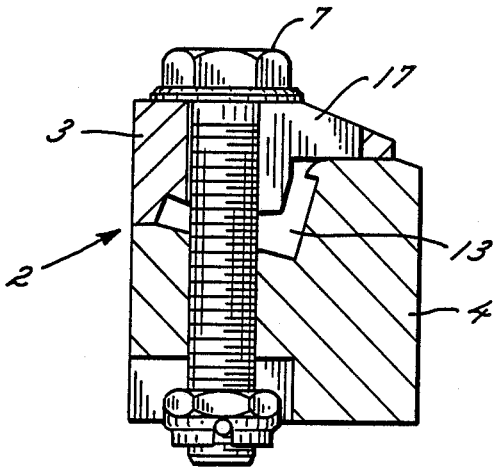
FIG. 6 is a detail of the cross-section along the line D—D in FIG. 1.
Figure 7:
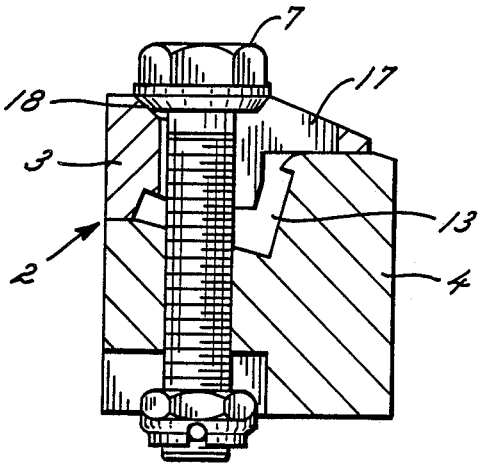
FIG. 7 is a detail of the cross-section along the line E—E of FIG. 1.
Figure 4:
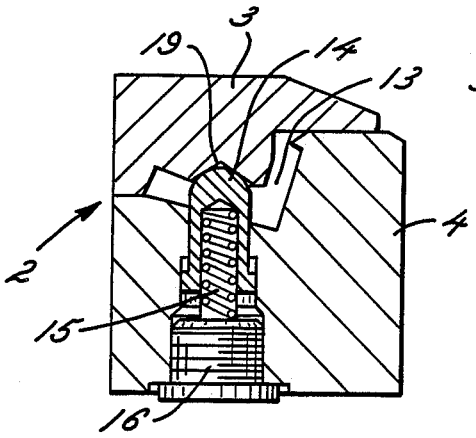
FIG. 4 is a detail of the cross-section along the line C—C in FIG. 1 with the clamp bars closed.
Figure 5:
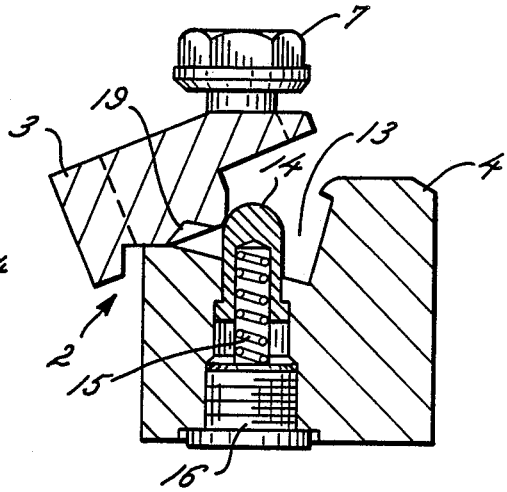
FIG. 5 is a detail of the cross-section along the line C—C in FIG. 1 with the clamp bars open.

Turning now to the drawings, there is shown in FIG. 1 a plate cylinder 1 for recessed in-line varnishing in a rotary printing press which has clamp bars 2 disposed parallel to the cylinder axis in known manner in the channel. The clamp bars 2 consist of a top part 3 and a bottom part 4 between which it is possible to clamp a printing plate 5, e.g. a Nylonprint-Letterset plate as shown in FIG. 2 or a blanket 6 as shown in FIG. 3, by clamping screws 7. The clamp bars 2 are circumferentially adjustable in a parallel or an inclined relationship to one another in guides 8 by means of clamp screws 10 bearing against the plate cylinder 1, and are also axially adjustable by means of axial setscrews 11 bearing against the plate cylinder 1. In this way it is possible to accurately position the printing plate 5 or the blanket 6 in relation to the print for recessed in-line varnishing. So that reinforced bent ends of the blanket can be inserted, the top part 3 is pivotally and slidably connected to the bottom part 4 as shown in FIG. 5 by locking devices 14, 15, 16, 19 (FIGS. 4 and 5) and recesses 17 (FIGS. 1, 6, 7) for the clamp screws 7 with the necessary opening width. The locking devices 14, 15, 16, 19 have a pressure member 14 which by way of a compression spring 15 bears on a closure screw 16 fixed in the bottom part 4 and is guided in a centering means 19 in the top part 3. As shown in FIG. 7, the top part 3 also has two additional centering means 18 for at least two clamping screws 7, while all the other clamping screws 7 have no additional centering means as shown in FIG. 6. The centering means 18 is very important for securing the position of the top part 3, particularly for reliable clamping of a printing plate for recessed in-line varnishing and if it is to be reliably positioned in relation to the print. To fix the reinforced bent ends of the blanket 6 a groove 13 is also provided which extends over the entire length of the bars 2 in the bottom part 4. A retaining means for the underlay 9 and a channel cover 12 as shown in FIG. 3 is also provided in known manner.

We claim as our invention:

1. A clamping device disposed in the channel of a rotary press cylinder for recessed in-line varnishing comprising, in combination, dual purpose clamping means disposed in said channel comprising means for optionally clamping a printing plate having substantially straight ends or means for optionally clamping a blanket having reinforced bent ends to said cylinder, said dual purpose clamping means including, as said plate clamping means, first sets of clamping screws and a pair of axis-parallel clamping bars each having a top part and a bottom part defining substantially axially and circumferentially disposed surfaces between which said printing plate ends are fixed by means of said first set of clamping screws, a plurality of clamping guides and second sets of clamping screws disposed in said channel, said clamping bars being circumferentially adjustable in parallel or an inclined relationship to one another in said guides by means of said second sets of clamping screws bearing against said cylinder, a plurality of axial set screws disposed in said channel, said clamping bars also being axially adjustable by said setscrews, and said dual purpose clamping means including as said blanket clamping means said substantially axially and circumferentially disposed surfaces and a substantially radially disposed groove in which said reinforced bent blanket ends are inserted and are secured therein by said top part and said first sets of clamping screws.

2. A clamping device as defined in claim 3 wherein said top part of each of said clamping bars is formed with additional means cooperating with at least a pair of said first set of clamping screws for centering said top part with respect to said bottom part of said clamping bar.

3. A clamping device as defined in claim 1 including a plurality of spring biased locking devices interposed between said top and bottom parts of said clamping bars, said top part being pivotally and slidably connected to said bottom part by said locking devices and said top part being formed with circumferentially extending recesses for said first sets of clamping screws.

4. A clamping device as defined in claim 2 wherein said centering means is formed on the underside of said top part for at least two of said locking devices.

* * * * *